US010544653B2

(12) United States Patent
Brandsdal et al.

(10) Patent No.: US 10,544,653 B2
(45) Date of Patent: Jan. 28, 2020

(54) DOWNHOLE TOOL

(71) Applicant: FRAC TECHNOLOGY AS, Ytre Arna (NO)

(72) Inventors: Viggo Brandsdal, Ytre Arna (NO); Geir Valestrand Aasheim, Ytre Arna (NO)

(73) Assignee: FRAC Technology AS (NO)

( * ) Notice: Subject to any disclaimer, the term of this patent is extended or adjusted under 35 U.S.C. 154(b) by 0 days.

(21) Appl. No.: 15/896,870

(22) Filed: Feb. 14, 2018

(65) Prior Publication Data

US 2018/0230772 A1 Aug. 16, 2018

(30) Foreign Application Priority Data

Feb. 15, 2017 (NO) ..... 20170229

(51) Int. Cl.

| | |
|---|---|
| ***E21B 34/06*** | (2006.01) |
| ***E21B 34/10*** | (2006.01) |
| *E21B 34/00* | (2006.01) |
| *E21B 43/26* | (2006.01) |

(52) U.S. Cl.

CPC ..... *E21B 34/063* (2013.01); *E21B 34/10* (2013.01); *E21B 43/26* (2013.01); *E21B 2034/007* (2013.01)

(58) Field of Classification Search

CPC ..... E21B 34/063; E21B 34/10; E21B 43/26; E21B 2034/007

See application file for complete search history.

(56) References Cited

U.S. PATENT DOCUMENTS

| | | | |
|---|---|---|---|
| 8,783,365 | B2 | 7/2014 | McCoy et al. |
| 9,004,180 | B2 | 4/2015 | Jackson |
| 2011/0030976 | A1 | 2/2011 | King |
| 2011/0203800 | A1 | 8/2011 | Tinker et al. |
| 2011/0284232 | A1 | 11/2011 | Huang |
| 2012/0085548 | A1 | 4/2012 | Fleckenstein et al. |
| 2013/0043041 | A1 | 2/2013 | McCoy et al. |
| 2013/0133897 | A1 | 5/2013 | Baihly et al. |
| 2014/0151054 | A1 | 6/2014 | Norrid |
| 2015/0159462 | A1 | 6/2015 | Cutler |

(Continued)

FOREIGN PATENT DOCUMENTS

| | | | |
|---|---|---|---|
| WO | WO 2010/127457 | A1 | 11/2010 |
| WO | WO 2015/134014 | A1 | 9/2015 |

(Continued)

OTHER PUBLICATIONS

Norwegian Search Report issued in Norwegian Patent Application No. 20170229 dated Aug. 28, 2017.

*Primary Examiner* — Matthew R Buck
*Assistant Examiner* — Aaron L Lembo
(74) *Attorney, Agent, or Firm* — Vinson & Elkins LLP

(57) ABSTRACT

A downhole valve has a housing with a longitudinal main passage and at least one valve port extending from the main passage and through the housing, a valve member is arranged in the main passage, the valve member arranged to cover the at least one valve port, wherein at least a part of the valve member is made of a degradable material which is reactive to water or a well fluid, and has a surface coating of a material which is non-reactive to water or the well fluid.

20 Claims, 10 Drawing Sheets

(56) References Cited

U.S. PATENT DOCUMENTS

| | | | | |
|---|---|---|---|---|
| 2015/0369003 | A1* | 12/2015 | Hajjari | E21B 29/002 166/298 |
| 2016/0290098 | A1 | 10/2016 | Marya | |
| 2017/0204700 | A1* | 7/2017 | Hughes | E21B 34/14 |
| 2017/0321513 | A1* | 11/2017 | Crow | E21B 23/06 |
| 2018/0128082 | A1* | 5/2018 | Hollan | E21B 34/14 |

FOREIGN PATENT DOCUMENTS

| | | | |
|---|---|---|---|
| WO | WO 2015/139111 | A1 | 9/2015 |
| WO | WO 2016/003759 | A1 | 1/2016 |
| WO | WO 2016/028154 | A1 | 2/2016 |

* cited by examiner

DOWNHOLE TOOL

CROSS-REFERENCE TO RELATED APPLICATIONS

This application claims priority to Norwegian Patent Application No.: 20170229, filed Feb. 15, 2017. The disclosure of the priority application is hereby incorporated in its entirety by reference herein.

The present invention relates to a downhole tool, and more particularly to a tool suitable for use in hydraulic fracturing operations.

BACKGROUND

When completing and prior to starting production in petroleum wells, it is sometimes necessary or desirable to carry out hydraulic fracturing operations (commonly referred to as 'fracking'). In such fracking operations, the well is pressurized with a hydraulic fluid, so as to fracture the formation and improve the flow conditions for the hydrocarbons.

It is preferable to carry out fracking operations individually and sequentially for different sections of the well; this avoids the need to pressurize the entire well and thus reduces the pumping capacity required for the operation. This can be done by arranging packer elements at longitudinal intervals on the outside of the production pipe that is led into the well at the reservoir. The packer elements, for example made from a rubber material, are arranged to swell up against the well casing or formation and form a seal in the annulus between the casing and the production pipe. By using several such elements, the well is divided into a number of closed zones between these seals.

A number of valves are arranged in the production pipe, corresponding to each zone. Commonly, each valve is opened by dropping a ball (or a different type of activation element) down into the production pipe, which then stops in a seat in the valve. The pressure is then increased above the ball and a slide or casing mechanism is pushed down to open the valve. Normally this is achieved in that the valve that is placed uppermost in the production pipe has a ball seat with a large diameter, with the diameter of the ball seats of the other valves decreasing successively down the well. By first letting down a small ball in the pipe, one will then pass through all the upper valves and get the ball landed on the seat in the lowermost valve. Thus, one can choose the correct valve according to the size of the ball, in order to start the fracturing in a desired zone.

One limitation of this system is that it requires ball seats with a large diameter for the uppermost valves, and successively smaller and smaller ball seats as one proceeds down the well. If using a large number of zones, which is desirable in long wells or to obtain better fracturing performance, a large number of valves is required. Since the inner diameter of the production pipe is limited, this necessitates small increments between the size of the valve seats, and very small ball seats in the lowermost valves. This makes the process more prone to errors (e.g., that a ball gets stuck in the wrong valve or that the wrong valve is activated) and is undesirable during production from the well, when such valve seats create a flow restriction for the hydrocarbons flowing upwards in the production pipe. Moreover, the valve seats create obstacles if a tool, for example a wireline tool, is later to be used in the production string, for example for well intervention purposes.

Some prior art solutions have aimed at developing systems with ball-activated valves and where all valves can be activated by a ball of the same size. These are, however, generally mechanically complex and thus more expensive, and also prone to failures. Other alternatives also exist, such as using a wireline tool to activate the valves, however this is laborious and also carries a risk of errors, for example that the wireline tool gets stuck in the well.

Documents which can be useful for understanding the background include U.S. Pat. No. 9,004,180; WO 2016/028154; WO 2015/134014; US 2012/0085548; US 2011/0203800; WO 2010/127457; US 2014/151054; US 2011/030976; U.S. Pat. No. 8,783,365; and WO 2016/003759.

The present invention has the objective to provide tools and equipment suitable for use in hydraulic fracturing operations and associated methods, which provide advantages over known solutions and techniques in relation to the aspects mentioned above or others.

SUMMARY

In an embodiment, there is provided a downhole valve having a housing with a longitudinal main passage and at least one valve port extending from the main passage and through the housing, a valve member arranged in the main passage, the valve member arranged to cover the at least one port, wherein at least a part of the valve member is made of a degradable material which is reactive to water or a well fluid, and has a surface coating of a material which is non-reactive to water or the well fluid.

In an embodiment, there is provided a downhole valve having a housing with a longitudinal main passage and at least one valve port extending from the main passage and through the housing; a valve member made of a first material and arranged in the main passage, the valve member being movable between a first operational position in which the valve member covers the at least one port and a second operational position in which the valve member does not cover the at least one port; at least one container containing a second material, whereby the second material is reactive with the first material such as to make the first material more reactive to water or a well fluid; and a rupture element arranged such as to break the at least one container upon movement of the valve member.

In further embodiments there is provided a method of operating a downhole valve, and a method of fracturing a subterranean formation.

Yet further embodiments are set out below.

BRIEF DESCRIPTION OF THE DRAWINGS

Illustrative embodiments will now be described with reference to the appended drawings, in which.

DETAILED DESCRIPTION

Figure 1A:
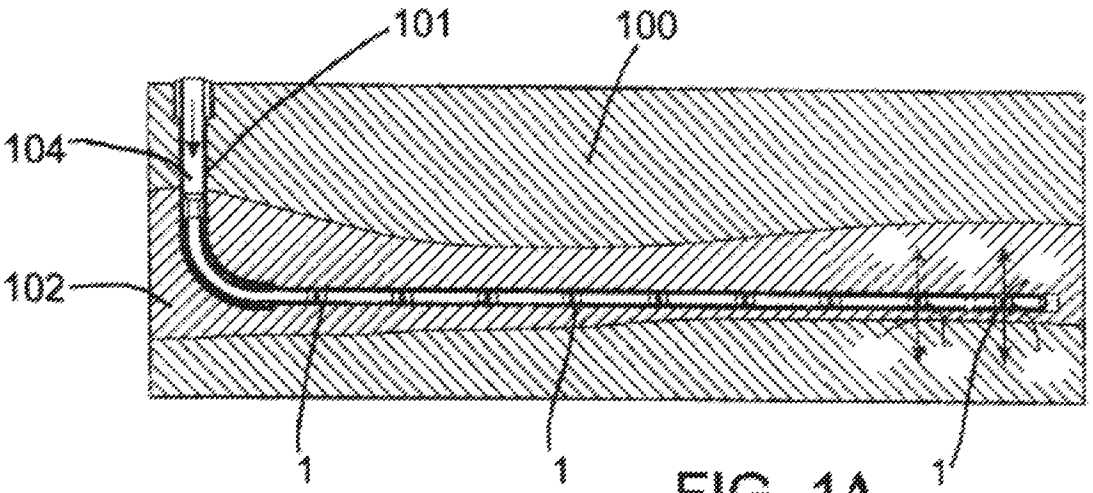
FIGS. 1A and 1B illustrate a petroleum well.

FIG. 1A shows a part of a typical conventional well 101 which extends from a surface and into an oil/gas-carrying section 102 of a subterranean formation 100. A production string 104 extends down into the well. In this example, the well extends vertically at first and then turns into a near horizontal direction, however the well may be entirely vertical or extend at any angle. In this example, nine valves 1 are installed in the production string 104. The valves 1 can be activated so as to allow pumping of hydraulic fluid into sections of the oil/gas-carrying section 102 to fracture it and prepare it for production of oil/gas.

Figure 1B:
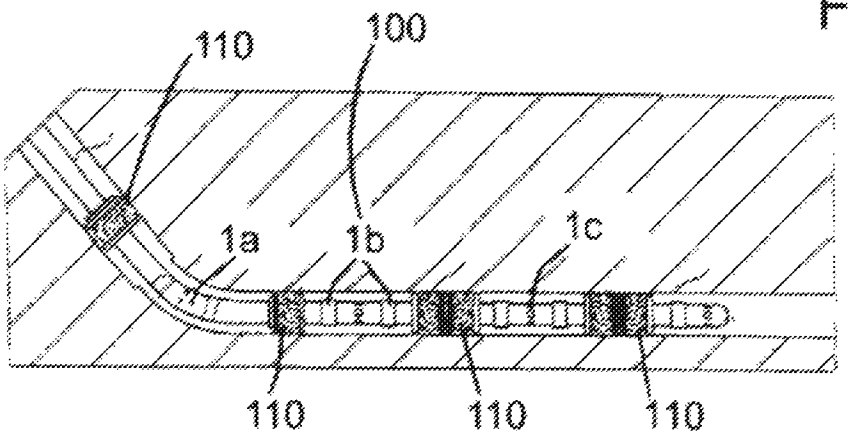

FIG. 1B shows an enlarged section of a part of the well and shows packer elements 110 placed around the production string 104 between each valve 1 so as to isolate sections of the well for fracturing of the formation. In the example shown in FIG. 1B, three such sections (or zones) are set up and three valves, 1*a*, 1*b* and 1*c*, are each arranged in a respective section.

The process of fracturing is exemplified in FIG. 1 with the arrows showing a flow of hydraulic fracturing fluid into the production string 104 and out through the two lowermost valves 1. ("Lowermost" here refers to the far, downhole, end of the production string or wellbore, as seen from the surface, even though the well may extend partly or fully horizontally.) Prior to starting the fracturing process, the two lowermost valves will have been opened by dropping or pumping a ball (or equivalent activation element) down into the production string 104, with the ball landing in a seat in the respective valve, and pressurising the production string 104 such as to open the valve 1. Opening the valve 1 permits fracturing fluid to be pumped via the production string 104 into the formation 100.

FIGS. 2A-2E shows a valve 1 according to one embodiment. The valve 1 has a housing 10 with a main passage 11 therethrough, and is configured to be arranged in a production string 104 (see FIG. 1A, 1B) in a well completion. The housing 10 has a plurality of ports 13*a-n* (FIGS. 2B-2E illustrating two ports 13*a* and 13*b*) arranged around its circumference. The ports 13*a-n* provide a fluid connection between the main passage 11 and the outside of the valve 1, i.e. the annulus between the production string 104 and the casing or formation in the well.

Referring to FIGS. 2B-2E, a sleeve 12 is arranged in the main passage 11, the sleeve 12 being movable between a first ("closed") operational position in which a part of the sleeve blocks the ports 13*a-n* and a second ("open") operational position in which the sleeve does not block the ports 13*a-n*. The sleeve has a seat 14 which is configured to receive an activation element for activating the valve 1. The activation element in the embodiment shown in FIGS. 2A-E is a ball 15, however may be of any suitable type, such as a frac dart, viper dart, or cement dart, or any applicable activation element which can be dropped or pumped into the production string 104. The sleeve 12 may, optionally, be secured in the closed position by a shear pin, a shear ring or the like, which is torn or broken upon activation of the valve 1 with the activation element 15, as described in further detail below.

The sleeve 12 is made from a degradable material which is reactive to water or well fluids, and has a coating or layer on its surface of a material which is non-reactive to water or well fluids. Well fluids may be, for example, water, hydrocarbons in liquid or gaseous form, drilling mud, etc. The degradable material may be, for example, an aluminium alloy, an aluminium-copper alloy, magnesium alloy or other well fluid degradable alloy. It is common in the industry to use degradable frac balls made of for instance aluminum alloys, magnesium alloys or zinc alloys that will dissolve in the well fluids. Any material currently used for such dissolvable frac balls may be relevant for use in embodiments of the present invention. The differences in metal alloy compositions is virtually unlimited and may be selected such as to provide a desired degradation speed. Non-metallic materials that dissolve in well fluids or water and which can be coated with a non-dissolving coating can also be used.

In the embodiment shown, the degradable material is AlGa. The coating or layer may be, for example, DLC (diamond-like-carbon), PVD (physical vapor deposition), EBPVD (electron beam physical vapor deposition), powder coating with thermosets and or thermoplastics, TSC (thermal spray coating), HVOF (high velocity oxy-fuel coating), shrouded plasma-arc spray coating, plasma-arc spray coating, electric-arc spray coating, flame spray coating, cold spray coating, epoxy coatings, plating including HDG (hot-dip galvanizing), mechanical plating, electro plating, non-electric plating method, all of which can be done with metals such as chromium, gold, silver, copper or other applicable metal; paints and other organic coatings, ceramic polymer coatings, nano ceramic particles or other nano particle coatings, rubber coatings, plastic coating, vapor phase corrosion inhibitor (VpCI®) technology or xylan coatings.

The sleeve 12 forms a constriction 19 in the main passage 11 by a part of the sleeve 12 which extends inwardly towards the main passage 11. The seat 14 is arranged on the part extending inwardly towards the main passage 11. In an embodiment, at least the part of the sleeve 12 which forms the constriction 19 and/or which forms the seat 14 is made of the degradable material. Other parts of the sleeve 12 may be made of other types of material, or form a support element 51 (see FIG. 5A) which is made of a different material.

In the embodiment shown in FIGS. 2A-2E, the sleeve 12 has a number of openings 16*a,b*. The number of openings 16*a,b* can be the same as the number of ports 13*a,b*, or there can be fewer or more openings 16*a,b* than ports 13*a,b*. In the embodiment shown, the number of openings 16*a,b* is the same as the number of ports 13*a-n*, and each opening 16*a,b* is aligned with a respective port 13*a,b* in the valve's open position.

In use, the production string 104 (see FIGS. 1A,1B) comprises a number of valves 1, and is positioned in the well during completion. Each, or some of, the valves 1 in the production string 104 may have a design as shown in FIGS. 2A-2E.

When the well is to be fractured, the ball 15 is dropped down into the well. Different sized pairs of balls 15 and seats 14 may be used for the different valves 1, as described above. Thus, the valves 1 may have incrementally smaller seats 14 such that a smaller ball 15 may pass through a number of valves 1 having larger seats 14, before activating the lowermost valve 1 to fracture the lower section (or sections) of the well. Then, subsequently, a larger ball 15 may be used to activate the next valve 1, and a yet larger ball 15 used to activate the next valve 1, and so on.

Figure 2E:
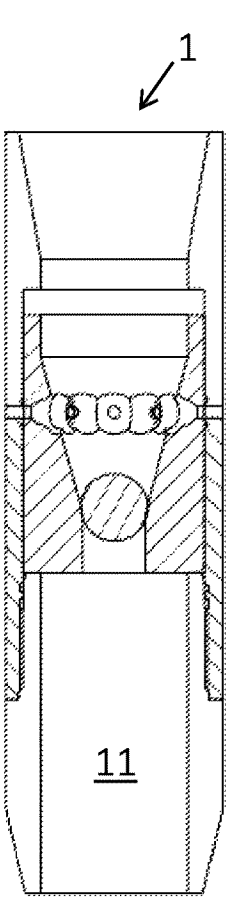
FIGS. 2A-2E show a valve according to an embodiment.
Figure 2D:
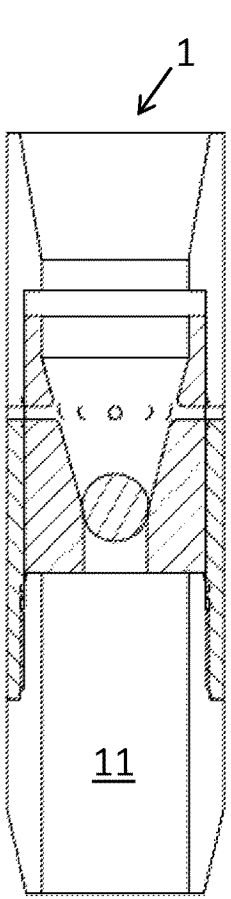
Figure 2C:
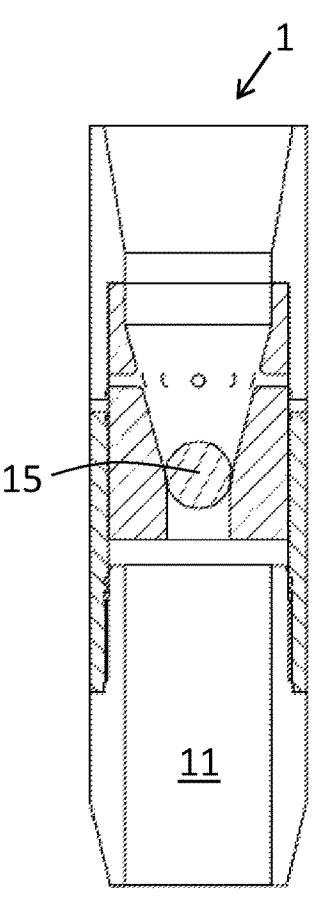
Figure 2B:
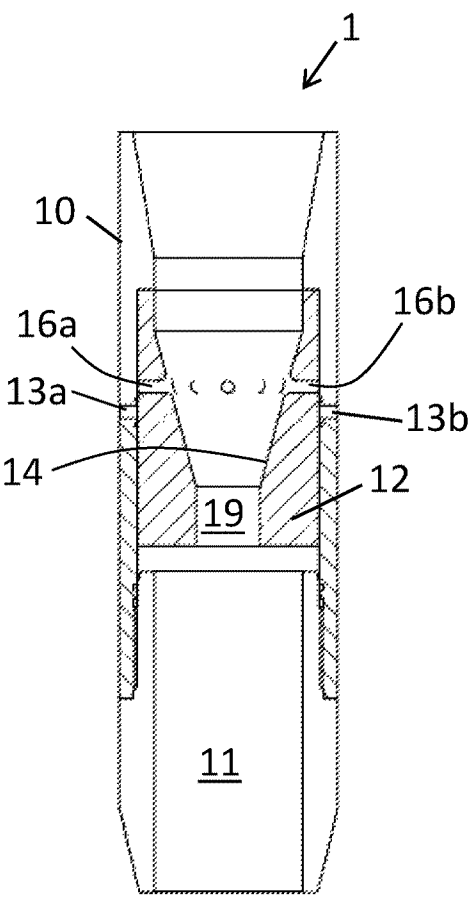
Figure 2A:
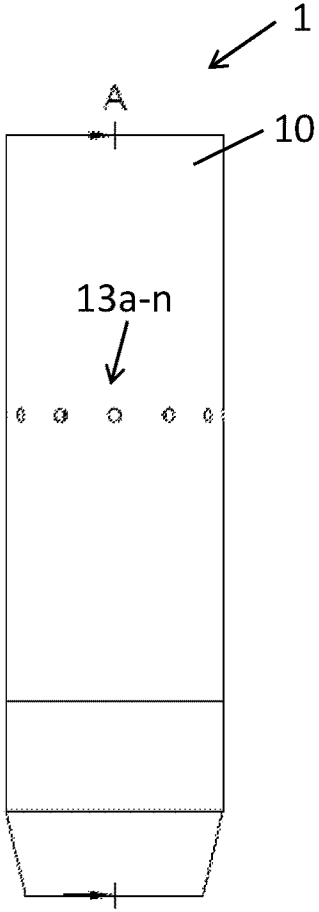

Each valve 1 is activated as illustrated in FIGS. 2B-2E. In FIG. 2B, the valve 1 is in the closed position. The main passage 11 is open, and the ports 13*a,b* are blocked by the sleeve 12. In FIG. 2C, a ball 15 has been dropped from surface and has landed in the seat 14. The ball 15 seals (fully or partially) against the seat 14. By applying a pressure from surface to the production string 104, for example by pumping a hydraulic fracturing fluid into the production string 104, the pressure force acting on the ball 15 and on the sleeve 12 will urge the sleeve 12 towards its open position. This situation is illustrated in FIG. 2D. The openings 16*a,b* are now aligned with the ports 13*a,b*, so that fluid communication is available between the production string 104 and the outside of the valve 1. Fracturing of the formation in that section can thus be carried out.

When pumping hydraulic fracturing fluid through the valve 1 and through the openings 16*a,b*, the coating or layer material on the sleeve 12 will be eroded away by the fracturing fluid. The fracturing fluid may comprise sand or other particles, which in particular may accelerate this erosion, and in particular in, and in the vicinity of, the openings 16*a,b* where the flow velocities and accelerations are high. Consequently, the degradable material of the sleeve 12 body will be exposed to the well fluids, and will start to degrade. The degradation may be, for example, the degradable material dissolving, corroding, disintegrating, or otherwise be removed or eliminated when in contact with well fluids. FIG. 2E illustrates the progressing degradation process, in the first instance in the region around the openings 16*a,b* and gradually progressing to the rest of the sleeve 12 body.

The sleeve 12 will then continue to degrade through reaction with well fluids, to the point where essentially the entire sleeve 12 is gone. Consequently, there will be no restrictions in the main passage 11, and essentially the full inner diameter of the production string 104 is available also through the valve 1. This ensures that the valve 1 does not pose a flow restriction for well fluids during production, and allows later use of tools (for example wireline tools) in the production tubing 104 without having to, for example, machine out the sleeve 12.

The ball 15 may also be made of a degradable material such that the ball 15 also dissolves. For example, the ball 15 may comprise an aluminum-based alloy matrix containing gallium. The material properties of the ball 15 and the sleeve 12 may be chosen so that the ball 15 dissolves faster than the sleeve 12, or vice versa.

FIGS. 3A-3D show an embodiment of a valve 1. In this embodiment, the sleeve 12 does not comprise openings, but is arranged to be movable such as to, in a closed position, block the ports 13*a,b*, and, in an open position, uncover the ports 13*a,b*.

Figures 3A, 3B, 3C, 3D:
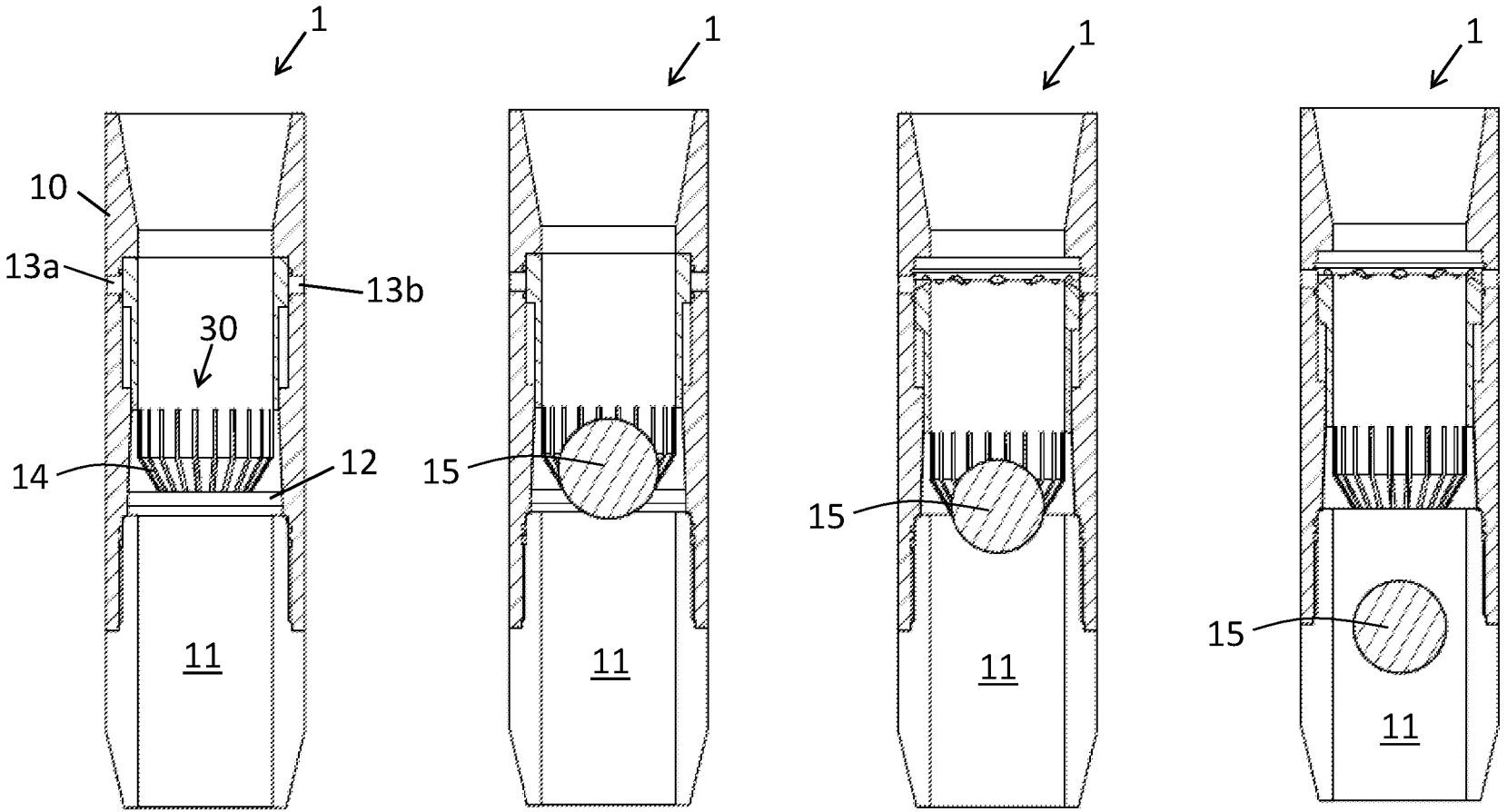
FIGS. 3A-3D show a valve according to an embodiment.

FIG. 3A shows the valve 1 in the closed position. In this embodiment, the valve 1 further comprises split fingers 30 which are arranged such as to form the seat 14. The split fingers 30 are pivotable and supported by a conical section of the housing 10 such that when the sleeve 12 is moved, the outer support of the split fingers 30 is removed. The seat 14 is thus retracted outwardly such that a ball 15 no longer finds support in the seat 14 and is permitted to proceed further downwards in the passage 11.

FIG. 3B illustrates the valve 1 when a ball 15 has landed in the seat 14 formed by the split fingers 30. The production string 104 can now be pressurized from above, in order to move the sleeve 12 in the valve 1. FIG. 3C shows the valve 1 in its open position, i.e. having uncovered the ports 13*a,b*. Fluid from the production string 104 is thus permitted to flow out of the ports 13*a,b*. When the fluid flows past the part of the sleeve 12 immediately adjacent the ports 13*a,b* (in this case the upper end of the sleeve 12), it will erode away the coating on this part, and the degradable material will be exposed to the well fluids and start to dissolve. FIG. 3C also shows, illustratively, this process of degradation having commenced.

As the split fingers 30 no longer provides support for the ball 15 in the open position of the valve 1, the ball 15 may proceed further downwards into the production string 104, as shown in FIG. 3D. This may be desirable, for example, if two (or more) valves 1 are to be opened at substantially the same time; in such a case the ball 15 may proceed to open subsequent valves farther down in the production string 104.

FIG. 4A-4F shows an embodiment of a valve 1. In this embodiment, the seat 14 is arranged to be movable with respect to the sleeve 12. Further, the openings 16*a,b* are arranged with shear pins 31*a,b*, which are configured such as to be sheared by the movement of the seat 14. The shear pins 31*a,b* block (or plug) the openings 16*a,b*, such that no fluid flow is possible. Upon breakage of the shear pins 31*a,b*, the openings 16*a,b* and the ports 13*a,b* are in fluid communication and fracturing fluid may be pumped out through the ports 13*a,b* and into the formation.

Figures 4A, 4B, 4C, 4D:
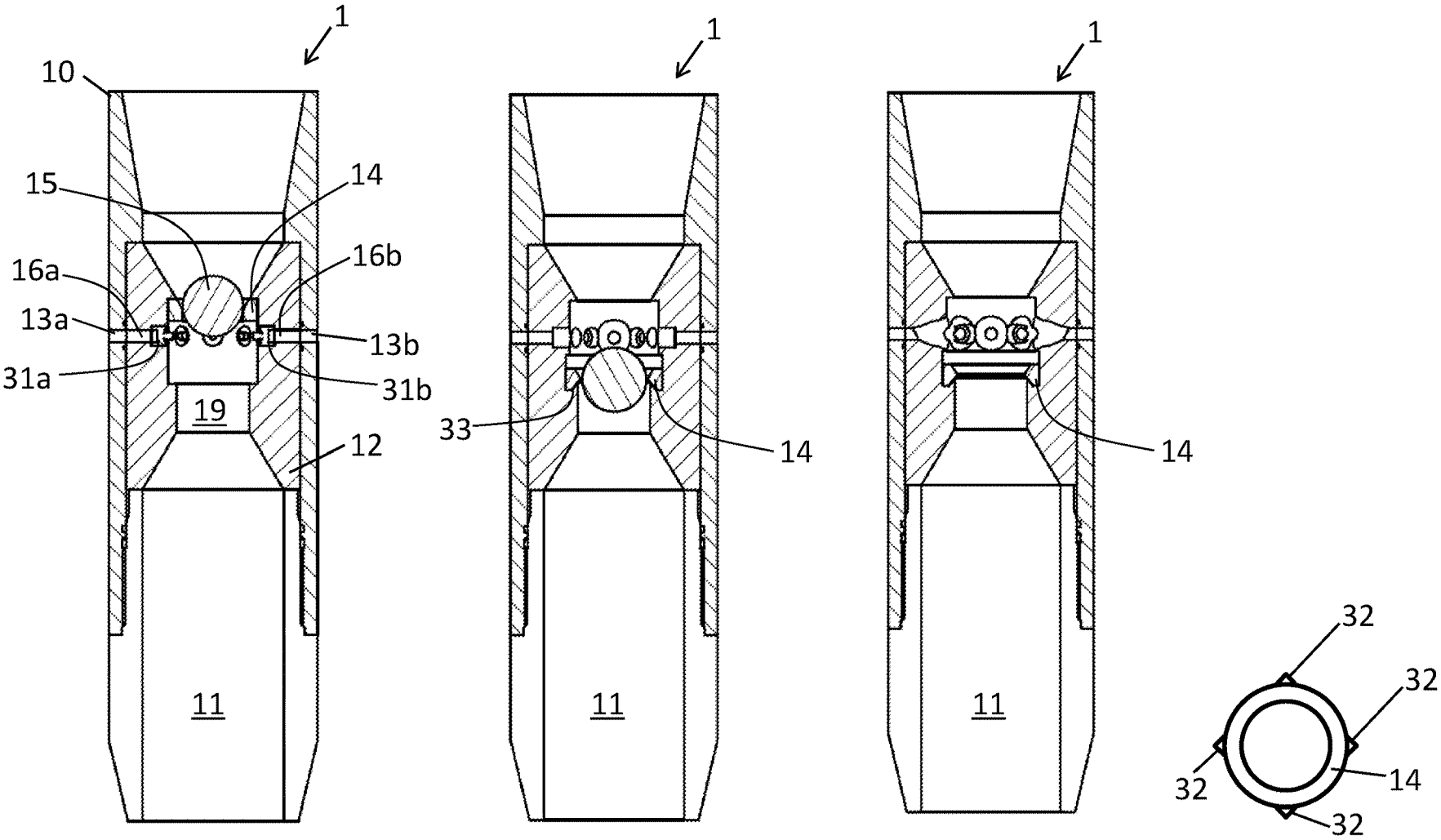
FIGS. 4A-4G show a valve according to an embodiment.

The shear pins 31*a,b* may be made of, for example, a glass, ceramic or other porous or breakable material. In this embodiment, the sleeve 12 can be arranged to be fixed (i.e., not movable) in the valve 1. Upon start of the flow of fracturing fluid, a part of the coating on the sleeve will be eroded away, initially around the openings 16*a,b*, and the sleeve will start to dissolve. Alternatively, or additionally, the movable seat 14 may be arranged with rupture pins 32, illustrated in FIG. 4D, showing the seat 14 seen from above. The rupture pins 32 perforate or otherwise damage the coating on the sleeve 12 when the seat 14 is moved. This exposes the degradable material and the degradation of the sleeve 12 will start.

FIG. 4A illustrates the valve 1 when a ball 15 has landed in the seat 14. FIG. 4B illustrates the valve 1 after the ball 15 and the seat 14 has been moved within the sleeve 12 upon fluid pressure being applied above the valve 1. Movement of the seat 14 breaks the shear pins 31*a,b* such that fluid starts flowing through the openings 16*a,b* and the ports 13*a,b*. This fluid flow erodes away part of the coating on the sleeve 12, such that degradation begins. Alternatively, or additionally, the coating on the sleeve 12 may be damaged by rupture pins 32 on the seat 14.

Figure 4G:
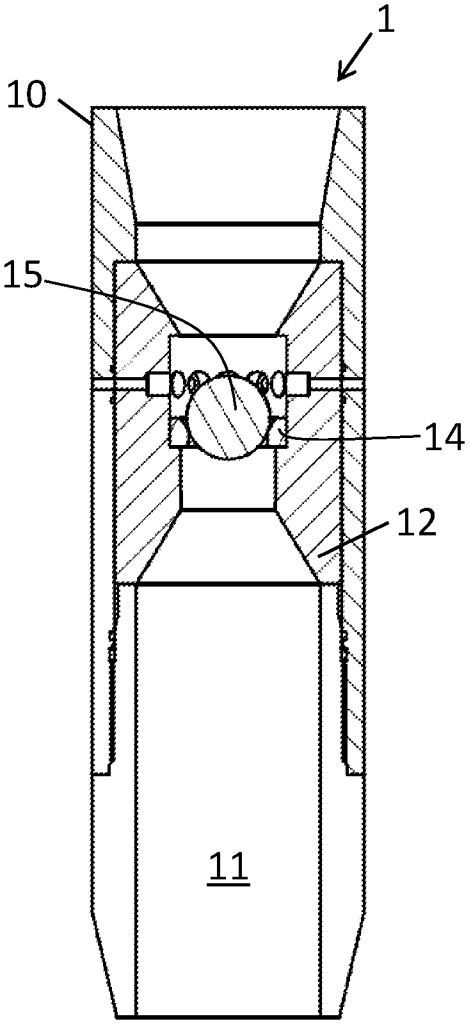

In this embodiment, the sleeve 12 has a conical lower support 33 for the seat 14 such that when engaging the lower support 33, the seat 14 is expanded and releases the ball 15. The seat 14 may be made up of sections which are movable in relation to each other for this purpose, or be of a material which is breakable when subjected to the outwardly directed forces from the lower support 33. In an alternative embodiment, shown in FIG. 4G, the lower support 33 is not conical but arranged to merely stop the seat 14 and support it in its lower position. In this embodiment, the ball 15 will be held fixed in the seat 14 after actuation of the valve 1. As described above in relation to FIGS. 3A-D, such different embodiments may be used if, for example, two or three valves 1 are to be actuated at substantially the same time, in which case one or two valves 1 may be arranged to actuate and immediately release the ball 15 for actuation of the lower valves 1, and a valve 1 according to the embodiment shown in FIG. 4G is arranged below the other(s) to stop and hold the ball 15.

Figure 4F:
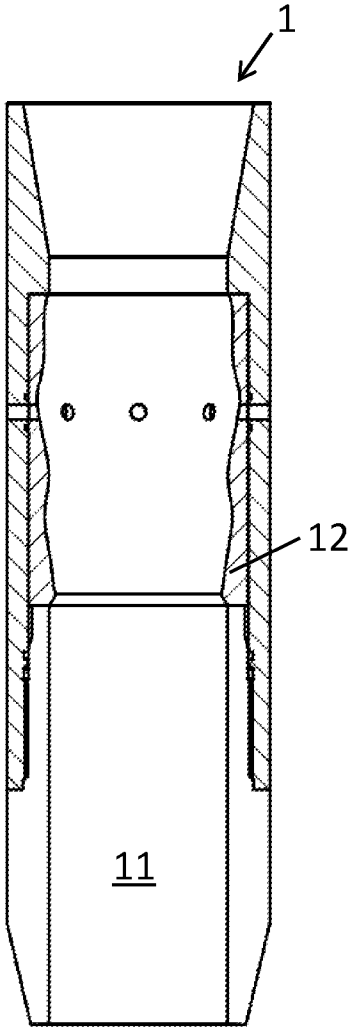
Figure 4E:
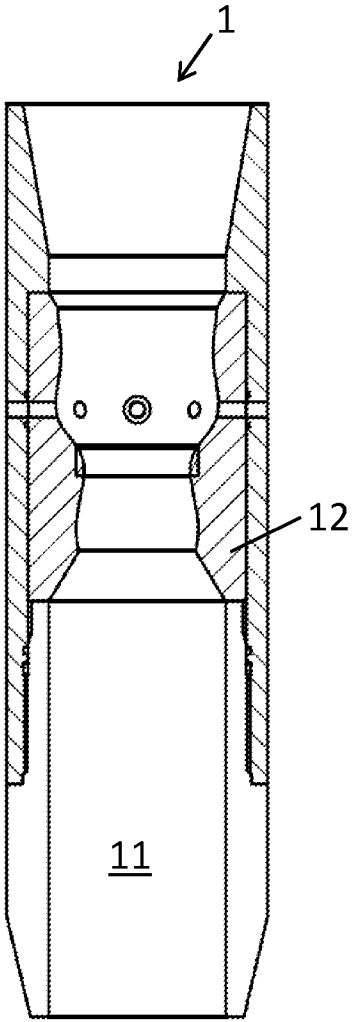

FIG. 4C shows the valve 1 after actuation and when degradation of the degradable material has started, initially in the area around the openings 16*a,b*. FIG. 4E shows the valve 1 when the degradation has proceeded further, and FIG. 4F shows the valve 1 when the degradation has proceeded yet further, to the point where the sleeve 12 has been almost entirely dissolved, such as to provide no restrictions to the inner diameter of the passage 11.

Figure 5C:
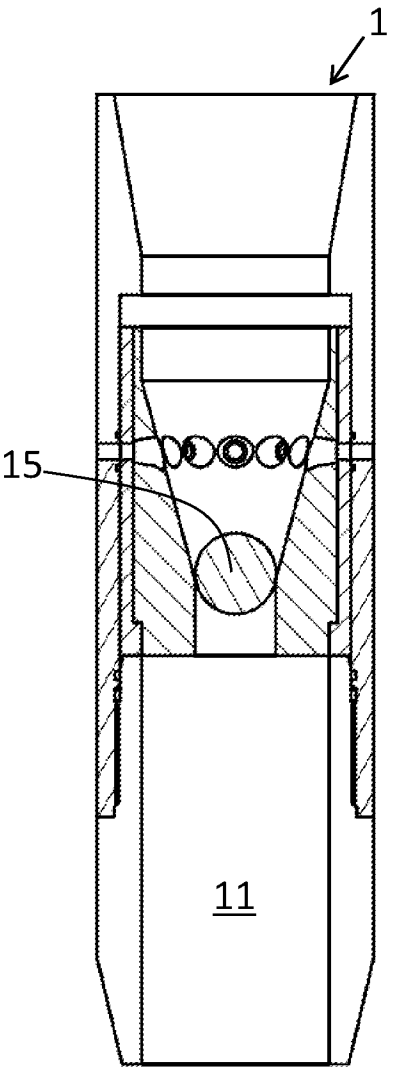
FIGS. 5A-5C show a valve according to an embodiment.
Figure 5B:
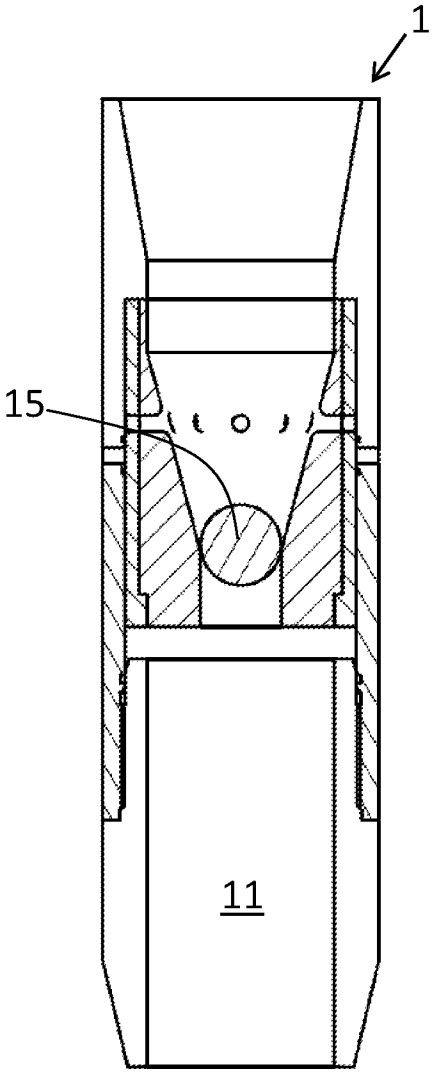
Figure 5A:
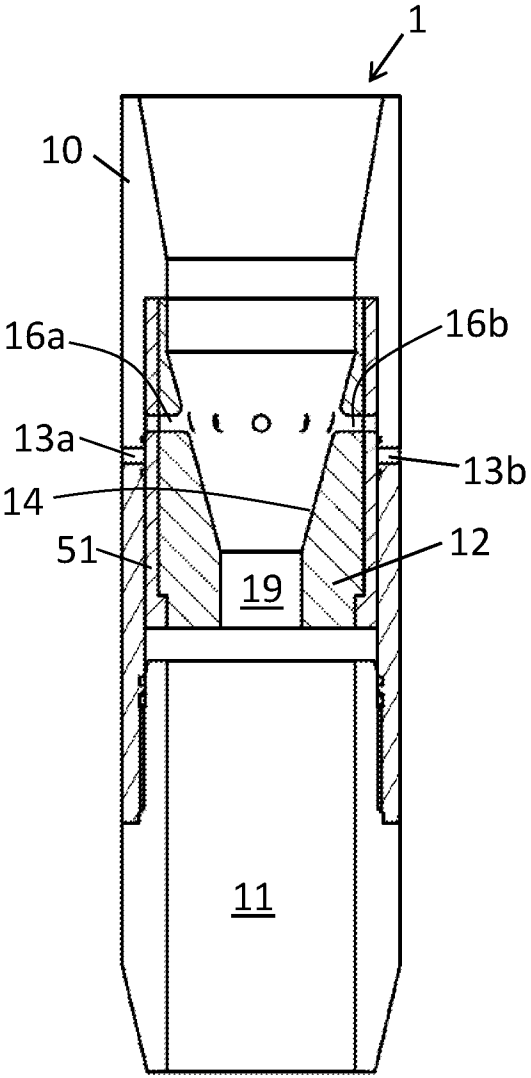

FIGS. 5A-5C illustrate an embodiment of a valve 1. In this embodiment, the sleeve 12 is provided with an outer support element 51. The outer support element 51 may be an outer support sleeve, as shown in FIG. 5A. The outer support element 51 is made of a rigid material which is non-reactive to water or well fluids, for example steel. The openings 16*a,b* may extend through the support element 51, as is the case in the embodiment shown in FIGS. 5A-5C.

FIG. 5A shows the valve 1 prior to activation. FIG. 5B shows a ball 15 having been passed down the production string 104 and into the seat 14. FIG. 5C shows the valve 1 after actuation and with the degradation of the sleeve 12 having commenced.

Figure 6B:
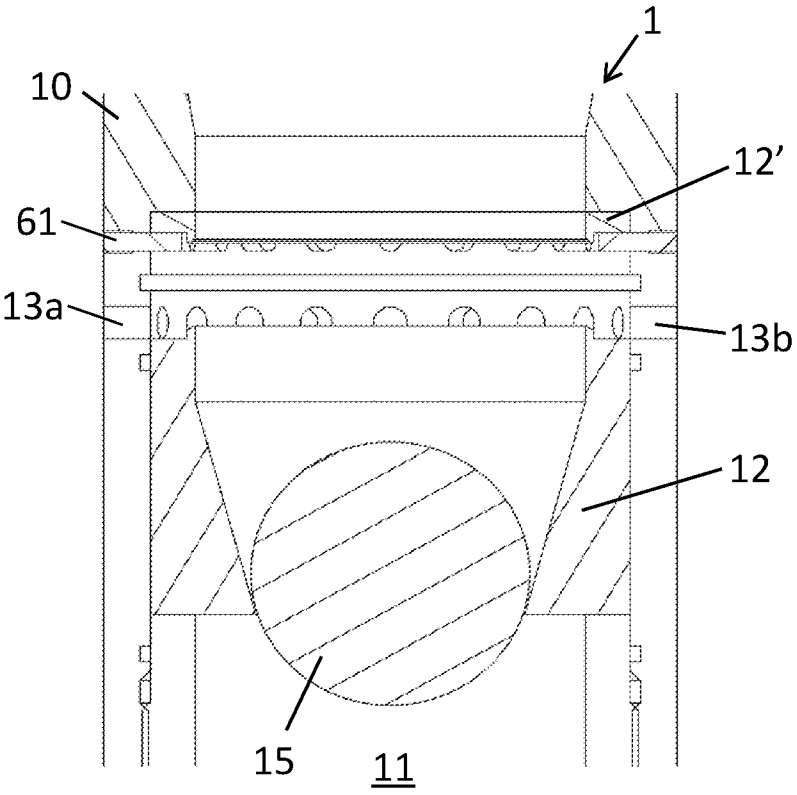
FIGS. 6A-6B show a valve according to an embodiment.
Figure 6A:
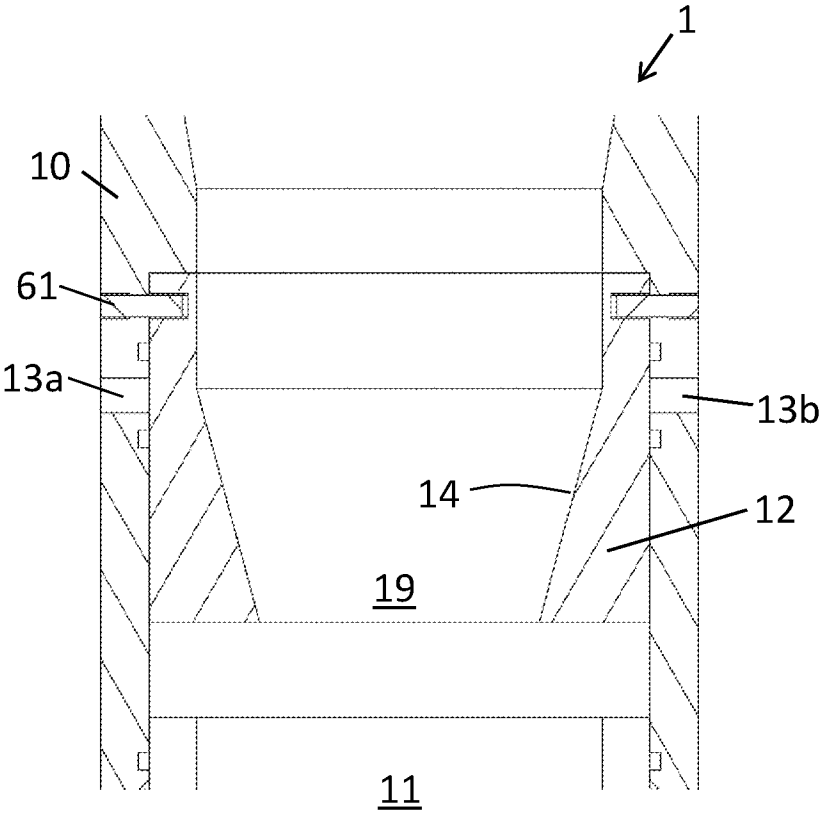

FIGS. 6A and 6B show one embodiment according to the invention. In this embodiment, the valve 1 has a rupture element 61 arranged in the housing 10 and configured to damage the coating upon movement of the sleeve 12. In the embodiment shown in FIGS. 6A and 6B, the rupture element 61 is an annular ring 61 fixed in the housing 10. The sleeve 12 has a recess into which the ring 61 extends in the closed position of the valve 1. The recess is arranged so that the thickness of the remaining material in the sleeve 12 near the recess is sufficiently thin that it can be sheared or broken off when applying an opening force to the sleeve 12. (I.e. in a similar manner as a conventional shear pin is arranged.) Upon movement of the sleeve 12, a part of the sleeve 12 is broken off, thereby exposing the degradable material, and degradation of the sleeve 12 will begin.

FIG. 6A shows the valve 1 in the closed position, while FIG. 6B shows the valve 1 in the open position. In this position, the ball 15 has been landed in the seat 14, a pressure has been applied from above to move the sleeve 12 downwards, and during that movement, a part 12' of the sleeve 12 has been broken off by the ring 61. This exposes the degradable material in the cut to well fluids, and it will start to dissolve.

In an alternative embodiment, the rupture element 61 can be arranged to damage the coating through abrasion. For example, the rupture element 61 may be one or more pins arranged in the housing 10 adjacent the outer surface of the sleeve 12, and arranged such that upon movement of the sleeve 12, the pins will scratch off the coating on the outside of the sleeve 12, thus damaging the coating through abrasion and exposing the degradable material. Other arrangements of the rupture element 61 is possible, for example arranging the rupture element 61 to tear or rip the coating when the sleeve 12 moves.

Figure 8A:
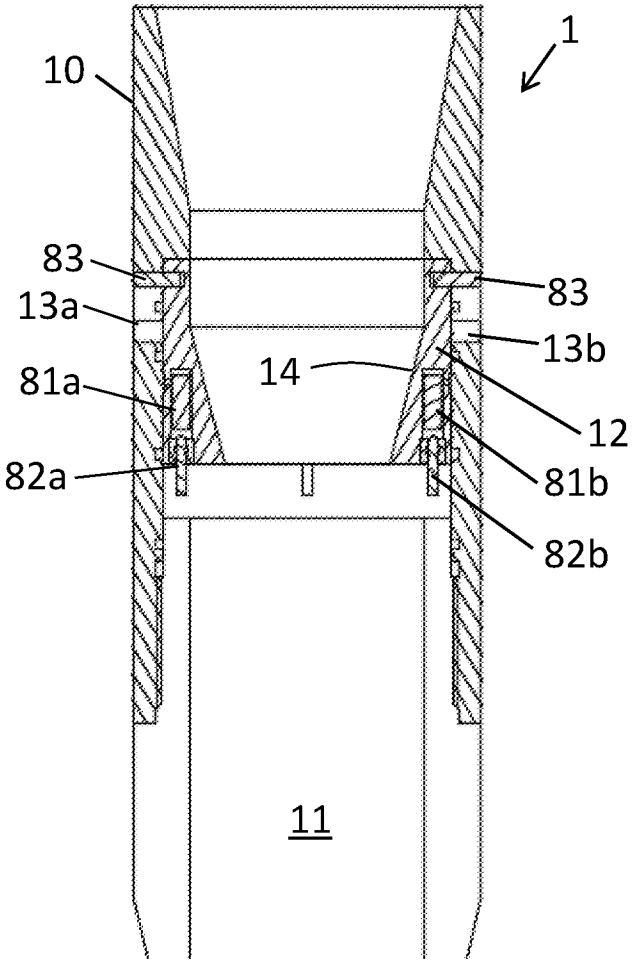
FIGS. 8A-8B show a valve according to an embodiment.
Figure 8B:
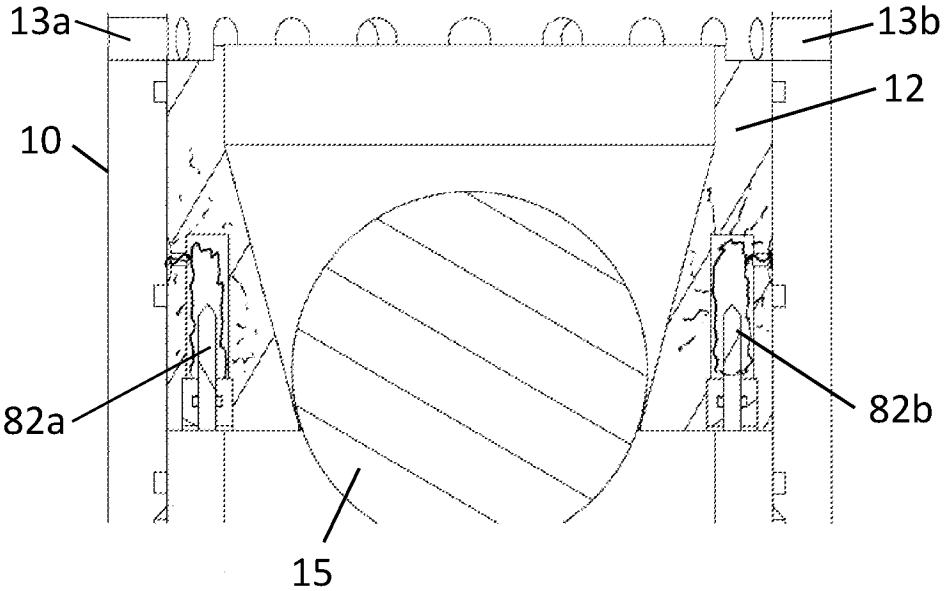

In one embodiment, illustrated in FIGS. 8A and 8B, a downhole valve 1 is provided. The valve 1 has a housing 10 with a main passage 11 and at least one port 13*a*,13*b* extending from the main passage 11 and through the housing 10. A valve member 12 is arranged in the main passage 11, the valve member 12 being movable between a first operational position in which the valve member 12 blocks the at least one port 13*a*,13*b* and a second operational position in which the valve member 12 does not block the at least one port (13*a*,13*b*). Shear pins 83 may be provided to initially hold the valve member 12 in the closed position, prior to activation of the valve 1.

In this embodiment, the valve member 12 is a sleeve, which is made of aluminium. Alternatively, the valve member 12 may be made of another material, such as an aluminium alloy, magnesium alloy, zinc alloy, or a suitable non-metallic material. The valve member 12 may have a coating of a material which is non-reactive to water or the well fluid, as described in relation to the embodiments described above.

Two containers 81*a* and 81*b* containing gallium are arranged in the valve member 12. Rupture elements 82*a* and 82*b* are arranged in relation to the containers 81*a* and 81*b*, respectively, such that upon movement of the valve member 12, the rupture elements 82*a,b* break the containers 81*a,b*. The rupture elements 82*a,b* may, for example, be a pin which is driven into the respective container 81*a,b*.

FIG. 8A shows the valve 1 in a closed position. FIG. 8B shows an extract of the valve 1 after an activation member 15 has moved the valve member 12. FIG. 8B illustrates, illustratively, that the rupture elements 82*a,b* have penetrated into the containers 81*a,b* and broken these. The gallium is then released, and starts to react with the aluminium in the valve member 12. The aluminium valve member 12 consequently becomes more reactive to water or well fluids, and will start to degrade when in contact with such fluids. The containers 81*a,b* thus enhances the degradation of the valve member 12 after activation, or may, in certain embodiments, start a degradation process which would otherwise not have taken place. This will be the case if the valve member 12 is made of a material which is substantially non-reactive to well fluids, but which becomes reactive to well fluids after being exposed to an activating material contained in the containers 81*a,b*.

Any suitable combination of materials in the valve member 12 and the containers 81*a,b* may be used. In this embodiment, an aluminium or aluminium alloy is used for the valve member 12 and gallium is used in the containers 81*a,b*. Alternatives to gallium may be mercury or mixtures or alloys containing gallium and mercury.

Figure 7C:
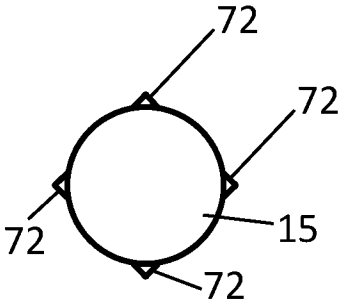
FIGS. 7A-7F show a valve according to an embodiment.

In an embodiment, illustrated in FIG. 7A-7F, the sleeve 12 is not movable in the housing 10. In this embodiment, the activation element 15 may have rupture elements 72, for example rupture pins 72 as illustrated in FIG. 7C and also visible in FIG. 7B. The rupture pins 82 are arranged to damage the coating when the activation element 15 lands in seat 14 and/or passes through the constriction 19. Alternatively, the sleeve 12 may have rupture elements arranged on the seat 14, in the constriction 19, or on another surface of the sleeve 12, which the activation element 15 engages when it proceeds down through the production string 104 and reaches the valve 1. Alternatively, the coating may be destroyed by a downhole tool for this purpose, such as a wireline tool.

Figure 7B:
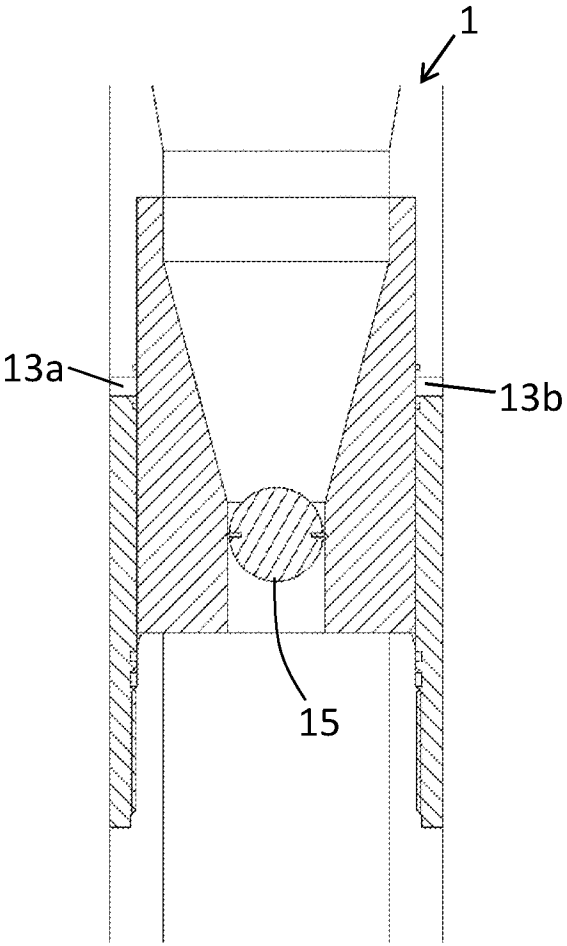
Figure 7A:
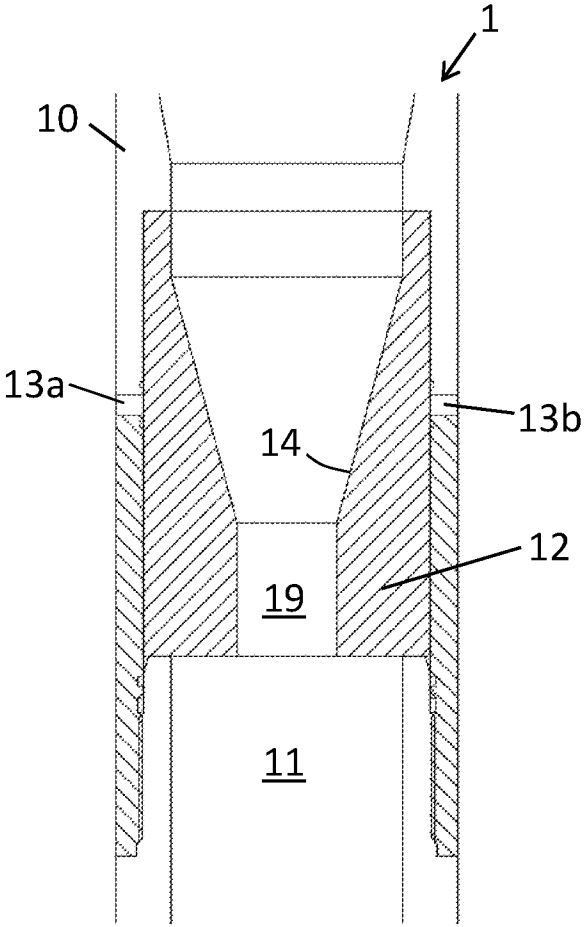

FIG. 7A shows the valve 1 in the closed position. The ports 13*a,b* are blocked by the sleeve 12 such as to prevent fluid communication between the main passage 11 and the outside of the valve 1. FIG. 7B shows an activation element 15 having been passed down through the production string 104 and to the valve 1. In this embodiment, the activation element 15 is of a size which allows it to pass through the constriction 19 without finding support in the seat 14. When passing through the constriction 19, the rupture pins 72 damage the coating of the sleeve 12 such as to expose the degradable material to well fluids.

Figure 7F:
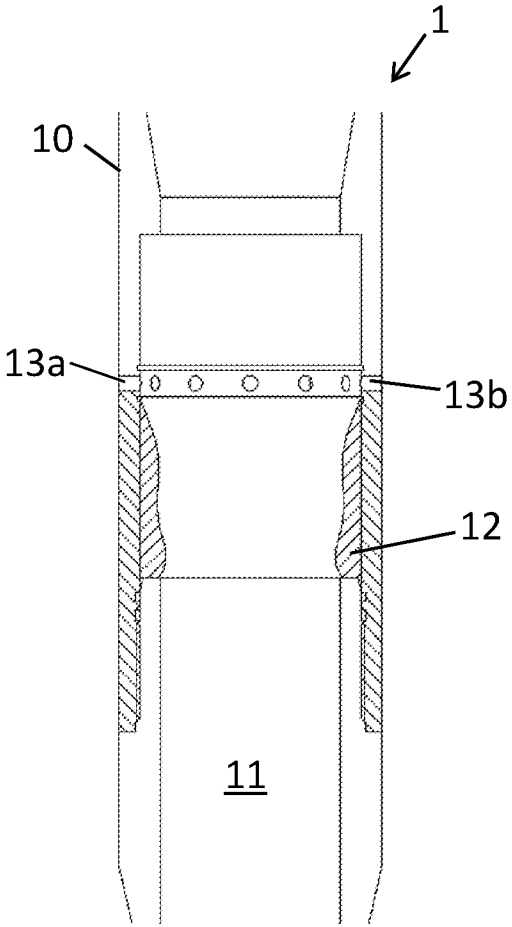
Figure 7E:
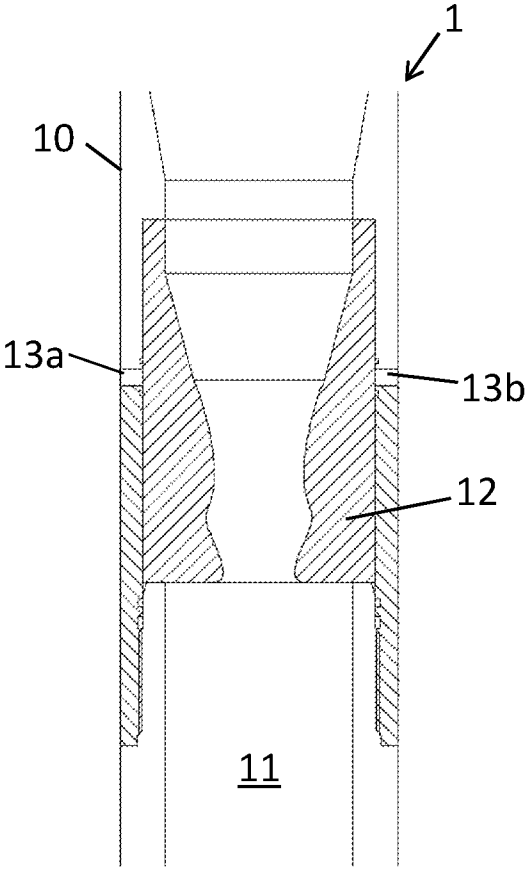
Figure 7D:
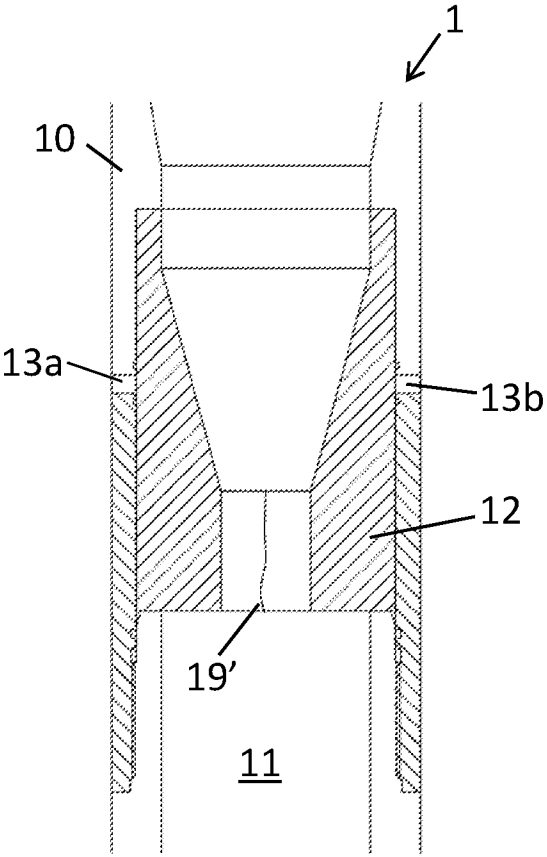

FIG. 7D shows the valve 1 shortly after the activation element 15 has passed through the constriction 19. Ruptures 19' in the coating in the constriction 19 exposes the degradable material of the sleeve 12 and starts the degradation process.

FIG. 7E shows the valve 1 after the degradation of the sleeve 12 has progressed, with parts of the sleeve 12 having dissolved away. FIG. 7F shows the valve 1 after the degradation has progressed even further, at this point the degradation of the sleeve 12 has progressed such as to uncover the ports 13*a,b*, and the valve 1 is in its open position.

In the various embodiments described above, the degradable material can be chosen, and the sleeve 12 so designed, such as to achieve a desired degradation time. This may be in the order of hours, days, or weeks, according to any specific requirement of the well and its operation. By using AlGa as the degradable material, one can for example achieve a comparatively quick degradation, while substantially pure aluminium (Al) ensures a slower degradation.

According various embodiments, it is also possible to accurately control the start of the degradation of the sleeve 12, in that the coating or layer will essentially prevent degradation until the valve 1 is activated and the coating or layer is punctured or eroded away in at least one area of the sleeve 12. This is an advantage if there is a time span between the time at which the well is drilled and completed, and the time at which the well is fractured and production starts. This time span can often be unforeseeable, and not known, at the time of well completion.

The sleeve 12 may be designed such that substantially the full inner diameter of the housing 10 is obtained after the degradation process has completed. After activation, the valve 1 thus does not pose a flow restriction for the well fluids or a restriction for use of e.g. downhole tool in the production string 104.

When used in this specification and claims, the terms "comprises" and "comprising" and variations thereof mean that the specified features, steps or integers are included. The terms are not to be interpreted to exclude the presence of other features, steps or components.

The features disclosed in the foregoing description, or the following claims, or the accompanying drawings, expressed in their specific forms or in terms of a means for performing the disclosed function, or a method or process for attaining the disclosed result, as appropriate, may, separately, or in any combination of such features, be utilised for realising the invention in diverse forms thereof. In particular, a variety of features associated with a downhole valve 1 have been described in relation to different embodiments. Although individual fetaures may have been described in relation to different embodiments, it is to be understood that each individual feature, or a selection of features, described above may be used or combined with any of the embodiments, to the extent that this is technically feasible.

The present invention is not limited to the embodiments described herein; reference should be had to the appended claims.

The invention claimed is:

1. A downhole valve comprising:

a housing with a longitudinal main passage and at least one valve port extending from the longitudinal main passage and through the housing, and a valve member arranged in the main passage, the valve member arranged to cover the at least one valve port, the valve member comprising a seat for receiving an activation element, wherein at least a part of the valve member is made of a degradable material which is reactive to water or a well fluid, and has a surface coating of a material which is non-reactive to water or the well fluid, wherein the seat is movable within the valve member, and wherein the seat comprises a rupture element arranged to damage the coating upon movement of the seat.

2. A downhole valve according to claim 1, wherein the valve member is fixed in the housing by a shear pin configured to be sheared by movement of the valve member.

3. A downhole valve according to claim 1, wherein the valve member is movable between a first operational position in which the valve member covers the at least one valve port and a second operational position in which the valve member does not cover the at least one valve port.

4. A downhole valve according to claim 3, wherein in the second operational position the at least one opening is aligned with the at least one valve port.

5. A downhole valve according to claim 4, comprising at least one shear pin arranged in the at least one opening and configured to prevent fluid flow through the at least one opening.

6. A downhole valve according to claim 1, wherein the valve member is a sleeve.

7. A downhole valve according to claim 1, wherein the seat is arranged in the valve member and arranged to be movable within the valve member.

8. A downhole valve according to claim 1, wherein the seat is arranged in the valve member.

9. A downhole valve according to claim 1, wherein a portion of the valve member comprises the seat.

10. A downhole valve according to claim 1, wherein the seat comprises a a retractable support element being operable to release the activation element from the seat.

11. A downhole valve according to claim 10, wherein the retractable support element comprise split fingers which are arranged to form the seat.

12. A downhole valve in accordance with claim 11, wherein the split fingers are pivotable and supported by a conical section of the housing, such that when the valve element is moved, the split fingers retract outwardly such that the seat releases the activation element.

13. A downhole valve according to claim 1, wherein the valve member forms a constriction in the main passage, and wherein said portion of the valve member forms the constriction.

14. A downhole valve according to claim 1, wherein the housing comprises a rupture element arranged to damage the surface coating upon movement of the valve member.

15. A downhole valve according to claim 14, wherein the rupture element is arranged to damage the surface coating through breaking of the valve member.

16. A downhole valve according to claim 14, wherein the rupture element is arranged to damage the surface coating through abrasion.

17. A downhole valve in accordance with claim 1, wherein the rupture element is a rupture pin configured to perforate or damage the coating upon movement of the seat.

18. A method of fracturing a subterranean formation, comprising:

actuating a valve according to claim 1 located in a production string extending into the formation, damaging the surface coating of the valve member, and pumping a fracturing fluid into the formation via the production string.

19. The method according to claim 18, wherein the actuating of the valve comprises passing an activation element through the production string and causing the activation element to actuate the valve.

20. The method according to claim 18, wherein the step of damaging of the surface coating of the valve member comprises:

pumping a fluid through the valve and causing an abrasion or erosion of the surface coating by the fluid, and operating a rupture element in the valve to damage the surface coating, or passing an activation element having a rupture element into the valve.

* * * * *